United States Patent [19]

Maldonado

[11] 4,005,869

[45] Feb. 1, 1977

[54] WIRE PUZZLE

[75] Inventor: Francisco Maldonado, Brooklyn, N.Y.

[73] Assignee: Lawrence Peska Associates, Inc., New York, N.Y. ; a part interest

[22] Filed: June 9, 1975

[21] Appl. No.: 585,364

[52] U.S. Cl. ..... 273/158

[51] Int. Cl.[2] ..... A63F 9/08

[58] Field of Search ..... 273/158

[56] References Cited

UNITED STATES PATENTS

| | | | |
|---|---|---|---|
| 939,552 | 11/1909 | Schesnack | 273/158 |
| 953,908 | 4/1910 | Hicks | 273/158 |
| 964,688 | 7/1910 | Parker | 273/158 |
| 1,176,015 | 3/1916 | Zubeck | 273/158 |

*Primary Examiner*—Anton O. Oechsle
*Attorney, Agent, or Firm*—Joel Halpern

[57] ABSTRACT

A wire puzzle comprising two elements. The first of such elements is a length of wire configured to include a plurality of serpentine loops, the entire length of wire forming a closed circuit. The second of such elements is a length of wire formed to provide at least three loops, the length of wire having a free end which terminates in spaced relation to a segment of the wire which has been bent to form the first of such loops and then the second. The wire segment, after formation of the first and second loops runs generally parallel to the segment terminating in the free end and thereafter forms the third loop about said first loop. By manipulation of the first element and its serpentine loops with respect to the three loops of the second element the two elements may be connected and disconnected without forcing.

5 Claims, 1 Drawing Figure

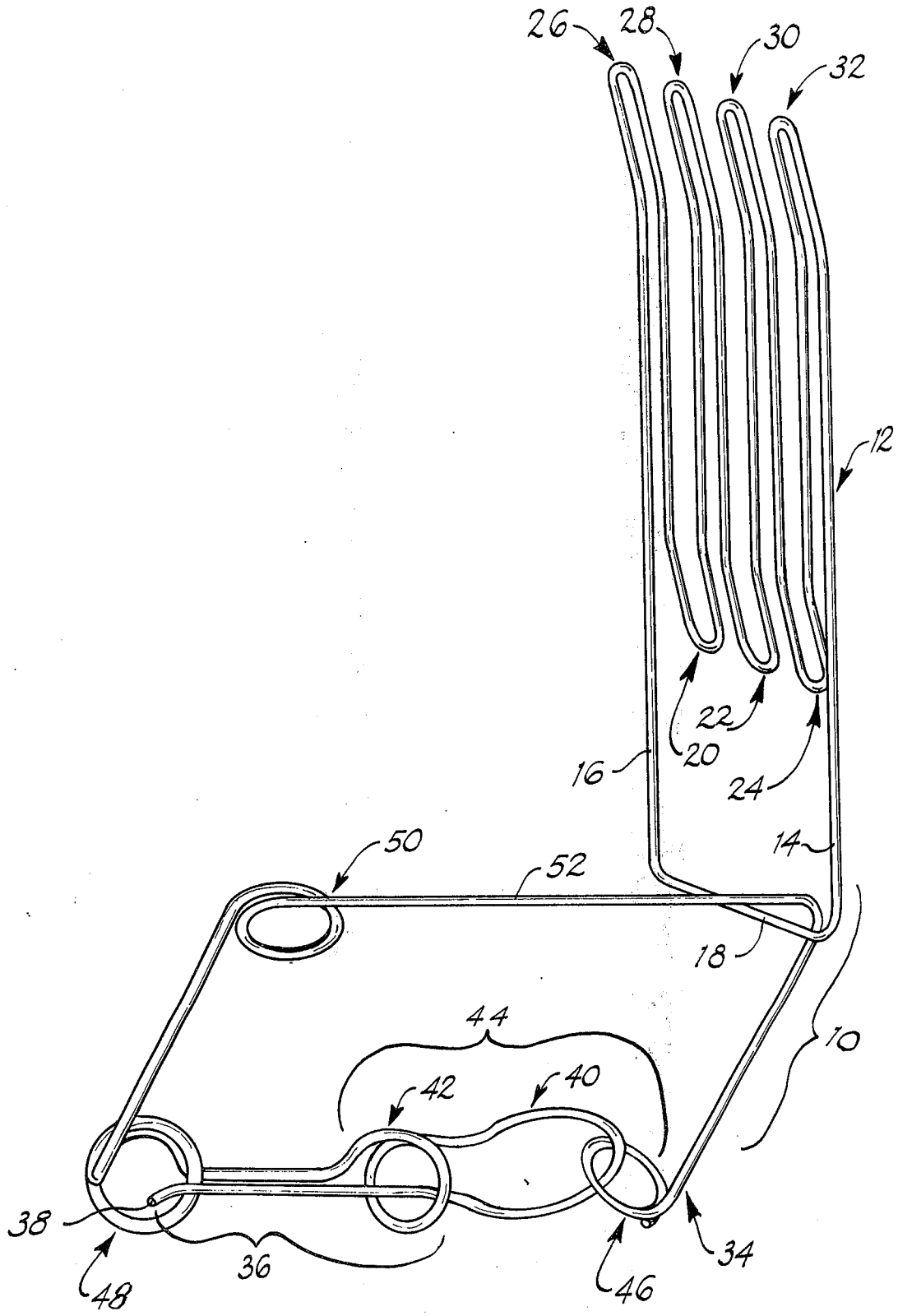
26
28
30
32
12
22
20
24
16
14
50
52
18
44
10
42
40
38
36
48
46
34

WIRE PUZZLE

BACKGROUND OF THE INVENTION

The invention relates to wire puzzles and more particularly to a wire puzzle comprising first and second elements which can be interconnected by manipulation of the parts without the need for forcing.

There are many prior patents which relate to puzzles comprising two or more component parts which, through manipulation can be selectively interconnected and disconnected. One such puzzle is disclosed in U.S. Pat. No. 1,176,015 granted Mar. 21, 1916 to Zubeck.

SUMMARY OF THE INVENTION

One object of the invention is the provision of a puzzle which comprises a pair of elements that are interconnectable through manipulation and which offers sufficient mental challenge to generate and sustain the interest of those inclined to test their mental prowess.

Another object of the invention is to provide a two component puzzle in which one of the components is configured to present a plurality of loops and the other component is given serpentine loops or fingers which cooperate with the loops of the other component to permit interconnection of the components and wherein one of the components is an endless length of wire.

Other objects and advantages of the invention will become readily apparent from the following description of the invention.

According to the present invention there is provided a wire puzzle comprising a first element formed of a first length of wire having opposed external reaches extending to terminate in a union at one end thereof and in a plurality of inwardly extending serpentine loops at the other end thereof, said opposed external reaches forming respectively the outer side of each of the outermost of said serpentine loops, the inner closed ends of said serpentine loops terminating in spaced relation to said union, and a second element formed of a second length of wire which includes a first segment extending from a free end of said wire a predetermined distance to a location at which the wire is bent about itself to form a first loop, the wire being configured in spaced relation to said first segment to form a second loop thereabout adjacent the end of said first loop closest to said free end, a second segment of said wire extending from said second loop in spaced generally parallel relation to said first segment beyond said free end and peripherally in a closed circuit to terminate in a third loop configured about the wire which forms said first loop and spaced therefrom.

BRIEF DESCRIPTION OF THE DRAWINGS

In order that the invention may be more fully understood it will now be described, by way of example, with reference to the accompanying drawing depicting: the two components of the puzzle in their interconnected relationship.

DETAILED DESCRIPTION OF THE INVENTION

Referring to the drawing there is shown a two component or two element puzzle 10. The first of such elements 12 is formed of a length of endless elongated material such as wire to present a pair of external reaches 14, 16 which terminate at one end in a union 18 shown as being a bight. At the other end of element

12 the external reaches ar configured to present a plurality of inwardly extending serpentine loops or fingers 20, 22, 24 and a plurality of outwardly directed loops or fingers 26, 28, 30, 32. The closed ends of loops 20, 22, 24 are offset out of the plane of the loops so as to facilitate manipulation of such loops as will become clear from the instructions for operation of the puzzle. The closed ends of outwardly directed loops or fingers 26, 28, 30, 32 ares similarly offset out of the plane of the loops in a direction opposite to the offset of loops 20, 22, 24 and likewise facilitate manipulation of the element to effect either interconnection or release of the elements. It will be observed that the external reaches 14, 16 form, respectively, the outer sides of the outermost loops 32 and 26. It will also be observed that the inner ends of the inwardly extending loops 20, 22 and 24 terminate in spaced relation to union or bight 18.

The general appearance of element 12 is rectangular and reaches 14, 16 are seen to extend in generally parallel relation. However, it is within the contemplation of this invention to curve the external reaches and the union or bight 18.

The second component or element of the puzzle 34 is formed of a length of elongated material such as wire. A first segment 36 of this element extends from the free end 38 of the element a predetermined distance to a location at which it is bent about itself to form a first loop 40. The wire is configured adjacent the end of said first loop closest to the free end 38 to form a second loop 42 in spaced relation thereabout. The wire then extends to form a second segment 44 between the thus formed second loop, in spaced relation to said first segment and generally parallel thereto, to form a peripherally closed circuit terminating in a third loop 46. The third loop encircles the end of loop 40 remote from loop 42. According to the preferred embodiment of the invention, although not essential to the operativeness of the puzzle, the second segment of element 34 is configured to form fourth and fifth loops 48, 50. Loop 48 is formed at the terminus of the free end 38, the material of the loop being spaced from the first segment of the element to permit the passage therebetween of one of the serpentine loops as will be subsequently described. It will be noted that one reach 52 of element 34 extends in a generally parallel path to the first segment 36 for a purpose to be described.

Loop 40 is conveniently formed with a larger diameter than that of loops 42 and 46 to permit the proper manipulation of element 12. Also, the width of the serpentine loops or fingers of element 12 are necessarily smaller than the inner diameter of loops 40, 42 and 46 to permit passage of such fingers through the loops as described hereinafter.

OPERATION OF THE PUZZLE

With elements 12 and 34 in a non-interconnected relationship element 34 is held in the left hand gripping the element at loop 50. The free end 38 of the element should be extended to the left. Element 12 is grasped with the right hand such that the loops or fingers 20, 22, 24 face in the direction of loop 48 with the offset ends turned upwardly. Guide either of loops or fingers 26, 28 or 30 in contact with and across the top of segment 36 through loop 42 to the extent that the closed end of the selected finger travels beyond the free end 38. Once past free end 38 tilt element 12 such that upon guiding the element in the reverse direction the selected finger now travels beneath segment 36 back through loop 42 until the closed end of such finger rides within loop 40 at the end adjacent loop 46. Rotate the element 12 in a counterclockwise direction into a substantially vertical position; then slide element 12 downwardly so that the closed end of the adjacent inwardly directed finger 20, 22, or 24 rides within and in contact with the lower portion of loop 40 and the sides of such inwardly directed finger 20, 22 or 24 straddle reach 52 of element 34. Next raise and rotate element 12 such that the closed end of the said adjacent inwardly directed finger 20, 22 or 24 glides in contact with the inner surface of loop 40 and through loops 46 and 42 beneath and in contact with the lower surface of segment 36 to a location beyond the free end 38. Guide the selected finger 20, 22 or 24 in the reverse direction over the top surface of segment 36 back through loops 42 and 46 so as to form the interconnection shown. In order to separate the elements simply reverse the foregoing steps.

It will be seen from the description of the invention that a unique arrangement of loops and fingers on elements 34 and 12 results in a puzzle which will provide entertainment as well as a mental challenge for children and adults alike.

What is claimed is:

1. A wire puzzle comprising a first element formed of a first length of wire having opposed external reaches extending to terminate in a union at one end thereof and in a plurality of inwardly extending serpentine loops at the other end thereof, said opposed external reaches forming respectively the outer side of each of the outermost of said serpentine loops, the inner closed ends of said serpentine loops terminating in spaced relation to said union, and a second element formed of a second length of wire which includes a first segment extending from a free end of said wire a predetermined distance to a location at which the wire is bent about itself to form a first loop, the wire being configured in spaced relation to said first segment to form a second loop thereabout adjacent the end of said first loop closest to said free end, a second segment of said wire extending from said second loop in spaced generally parallel relation to said first segment beyond said free end and peripherally in a closed circuit to terminate in a third loop configured about the wire which forms said first loop and spaced therefrom, the width of said serpentine loops being smaller in dimension than the inner diameter of said first, second and third loops.

2. A wire puzzle according to claim 1, wherein said second segment of said wire in the vicinity of said free end is configured to form a fourth loop and said free end terminates within the periphery of said fourth loop and therebelow.

3. A wire puzzle according to claim 1, wherein the periphery of said second element is generally rectangular.

4. A wire puzzle according to claim 1, wherein said serpentine loops extend in a generally parallel direction within and in the plane of said external reaches of wire and there are three inwardly extending loops.

5. A wire puzzle according to claim 1, wherein said first loop is larger than either of said second and third loops.

* * * * *